US005820392A

United States Patent [19]

Lin et al.

[11] Patent Number: 5,820,392

[45] Date of Patent: Oct. 13, 1998

[54] HIGH SPEED CARD EDGE CONNECTOR

[75] Inventors: Yu-Hsu Lin, Fremont, Calif.; Robert G. McHugh, Evergreen, Colo.; Hsiang-Ping Chen, Taipei Hsien, Taiwan

[73] Assignee: Hon Hai Precision Ind. Co., Ltd., Taipei Hsien, Taiwan

[21] Appl. No.: 764,046

[22] Filed: Dec. 12, 1996

[51] Int. Cl.[6] ..... H01R 13/652

[52] U.S. Cl. ..... 439/108; 439/60; 439/637

[58] Field of Search ..... 439/108, 637, 439/60, 947, 101, 630, 636, 260, 660, 751, 873, 924.1

[56] References Cited

U.S. PATENT DOCUMENTS

| | | | |
|---|---|---|---|
| 4,659,155 | 4/1987 | Walkup et al. | 439/108 |
| 4,806,110 | 2/1989 | Lindemann | 439/637 |
| 5,026,292 | 6/1991 | Pickles et al. | 439/636 |
| 5,634,819 | 6/1997 | Pan et al. | 439/637 |

*Primary Examiner*—P. Austin Bradley
*Assistant Examiner*—Tho D. Ta

[57] ABSTRACT

A card edge connector (10) includes an insulative housing (12) defining a card receiving central slot (14) for receiving a card (200) therein. Two rows of passageways (16) are respectively positioned by two sides of the central slot (14) for receiving a plurality of signal contacts (18) therein, respectively. A corresponding number of grounding contacts (20) are positioned in the same passageways (16) with the signal contacts (18), respectively, in a one-by-one relationship with the signal contact (18) wherein each grounding contact (20) is disposed in a lower and inner position in the corresponding passageway (16) in comparison with the signal contact (18) which shares the same passageway (16). A shorting bar or block (36) is inserted into the cavity (34) from the bottom and a series of grounding pins (42) are side by side arranged along the block (36) longitudinally whereby each grounding pin (42) has two opposite arms (46) for respective engagement with the corresponding pair of grounding contacts (20) positioned in the pair of passageways (16) in the same transverse plane and by two sides of the central slot (14). Each grounding pin (42) further includes a lead (48) extending downward toward the PC board (100) on which the connector (10) is mounted wherein the lead (48) is generally in the mid-position between two tails of the corresponding two signal contacts (18) sharing the same pair of opposite passageways (16) with such pair of grounding contacts (20).

13 Claims, 6 Drawing Sheets

HIGH SPEED CARD EDGE CONNECTOR

BACKGROUND OF THE INVENTION

1. Field of The Invention

The invention relates to high speed card edge connectors, and particularly to the card edge connector with ground contacts and the corresponding grounding bus thereof.

2. The Related Art

The high speed/frequency transmission was required in the recent computer industry, thus resulting in grounding consideration being substantially important for filtering any improper interference or noise generated by such high frequency transmission. The common design for removal such interference is to install a grounding circuits in the whole system, and similarly, in a connector which interconnects with the counterpart component, it also requires grounding contacts intermixed within the signal contacts for the same purpose. Most connector designs having grounding contacts therein, generally have several grounding contacts each shared by every three or four signal contacts. Understandably, in some severe condition, it is expected to have each signal contacts accompanied by a grounding contact for assuring a reliable and efficient grounding effect thereof. U.S. Pat. No. 5,026,292 discloses a card edge connector with signal contacts and grounding contacts by a one-by-one relationship. The stamped blanking type grounding contact with two cantilever beams upstanding at two opposite ends of its base for engagement with the corresponding pads disposed on two opposite surfaces of the inserted card. It is noted that the blanking type grounding contact lacks desired resiliency and tends to improperly scratch or damage the corresponding circuit pads during insertion of the card, so the forming type grounding contact is desired for the manufacturer and/or the user. The co-pending application having the same assignee with the invention and Ser. No. 08/585,894 filed Jan. 16, 1996, discloses a forming type of grounding contacts for use within a card edge connector.

Therefore, an object of the invention is to provide a card edge connector with grounding contacts each having a forming type structure for good resiliency thereof. Also, it is easy to assemble the whole connector and such connector has a preferred mechanical and electrical character for engagement with the inserted card.

SUMMARY OF THE INVENTION

According to an aspect of the invention, a card edge connector includes an insulative housing defining a card receiving central slot for receiving a card therein. Two rows of passageways are respectively positioned by two sides of the central slot for receiving a plurality of signal contacts therein, respectively. A corresponding number of grounding contacts are positioned in the same passageways with the signal contacts, respectively, in a one-by-one relationship with the signal contact wherein each grounding contact is disposed in a lower and inner position in the corresponding passageway in comparison with the signal contact which shares the same passageway. A shorting bar or block is inserted into the cavity from the bottom and a series of grounding pins are side by side arranged along the block longitudinally whereby each grounding pin has two opposite arms for respective engagement with the corresponding pair of grounding contacts positioned in the pair of passageways in the same transverse plane and by two sides of the central slot. Each grounding pin further includes a lead extending downward toward the PC board on which the connector is mounted wherein the lead is generally in the mid-position between two tails of the corresponding two signal contacts sharing the same pair of opposite passageways with such pair of grounding contacts.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
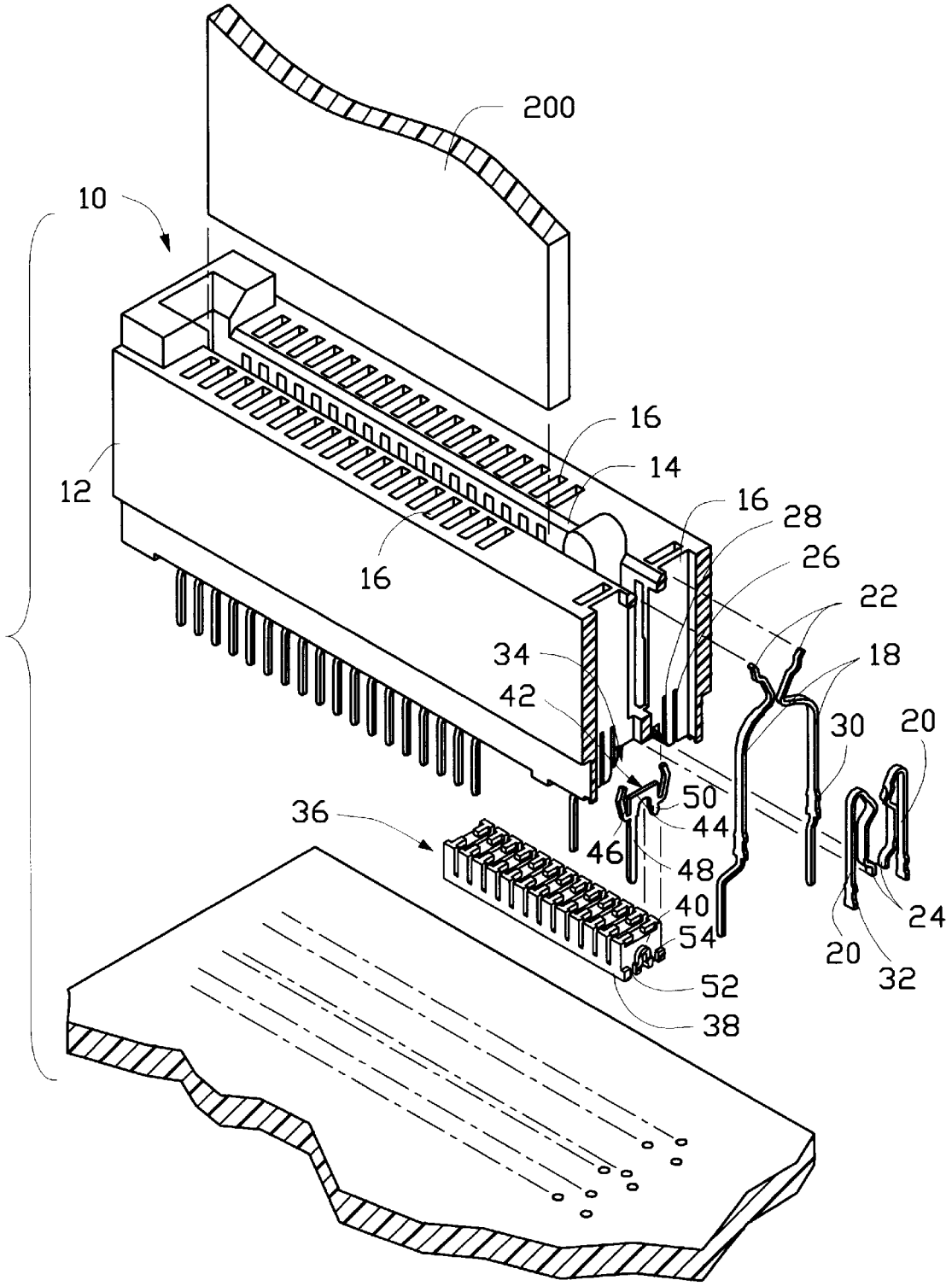
FIG. 1 is a fragmentary exploded perspective view, cut-away along the transverse plane, of a presently preferred embodiment of a card edge connector, according to the invention.
Figure 2:
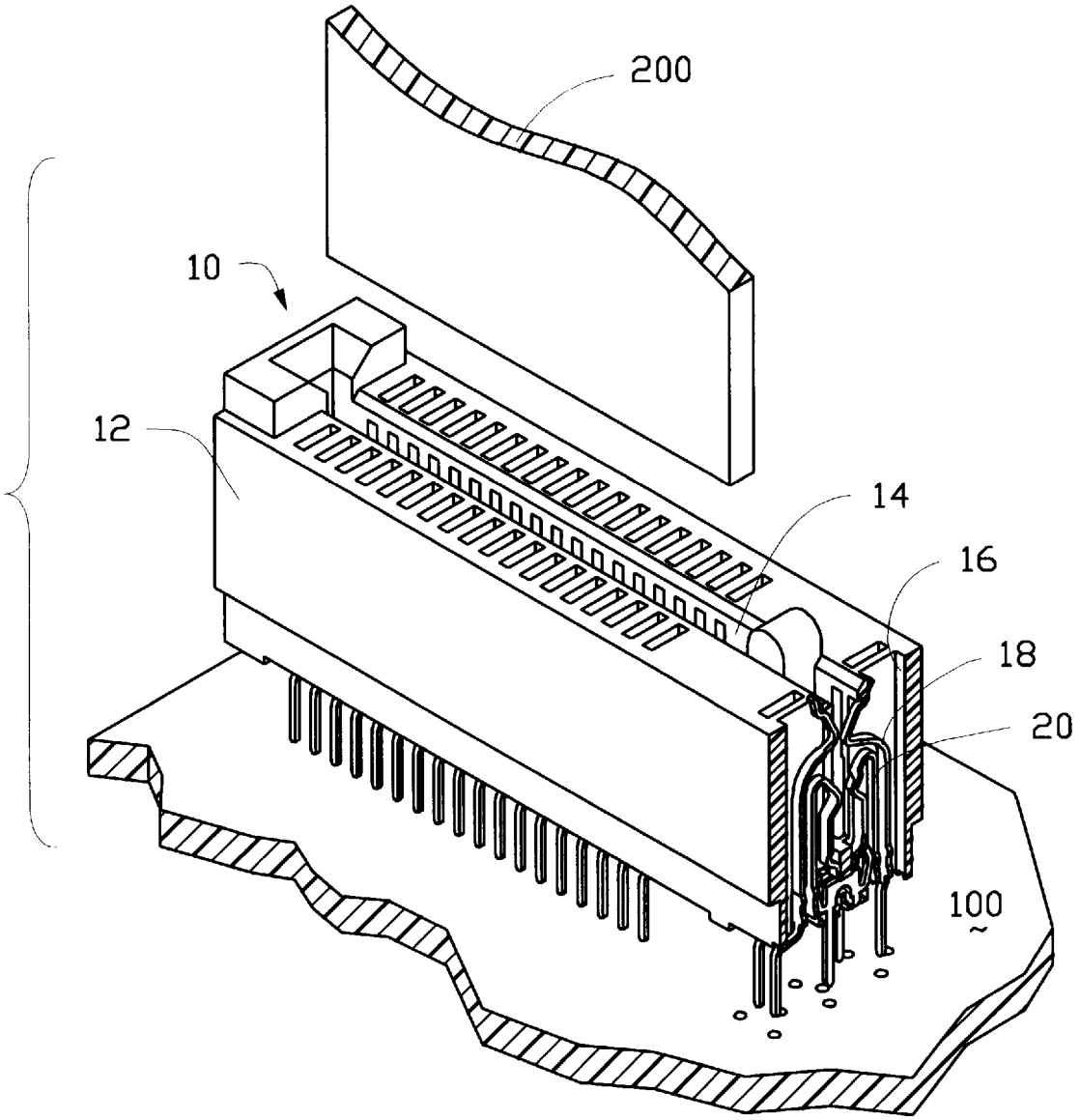
FIG. 2 is a fragmentary perspective view of the assembled card edge connector of FIG. 1.

It will be noted here that for a better understanding, most of like components are designated by like reference numerals throughout the various figures in the embodiments. Attention is directed to FIGS. 1 and 2 wherein a card edge connector 10 includes an insulative housing 12 defining a central slot 14 for receiving a card 200 therein. Two rows of passageways 16 are disposed by two sides of the central slot 14 for receiving a plurality of signal contacts 18 therein.

A same number of grounding contacts 20 are disposed in the passageways 16, respectively, each of which share the same passageway 16 with the corresponding signal contact 18. Each signal contact 18 has an engagement section 22 at the distal end for preloading consideration, and similarly each grounding contact has an engagement portion 24 at the distal end for the preloading purpose. In each passageway 16, the housing 12 includes a first pair of channels 26 and a second pair of channels 28 extending upward from the bottom surface 28 thereof for interferential engagement with the barbs 30, 32 on the corresponding signal contact 18 and grounding contact 20 for retaining the signal contact 18 and the grounding contact 20 in position in the passageway 16.

A central cavity 34 is formed in the bottom portion of the housing 12 for receiving a shorting bar 36. The shorting bar 36 includes an insulative body 38 with a series of passages 40, of which the number is a half of that of passageways 16. When the shorting bar 36 is assembled to the housing 12, each of the passages 40 is substantially transversely aligned with the corresponding pair of passageways 16 positioned by two sides of the central slot 14.

Figure 3:
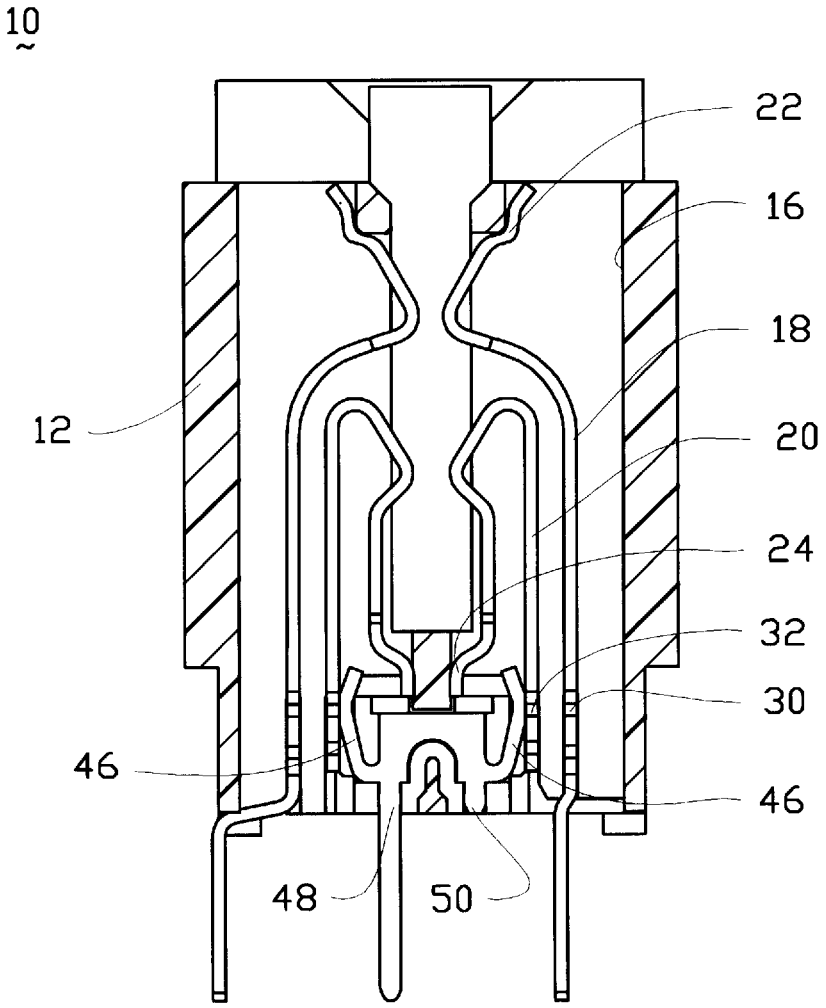
FIG. 3 is a cross-sectional view of the assembled card edge connector of FIG. 1 only showing one pair of signal contacts and its corresponding grounding pin.
Figure 4:
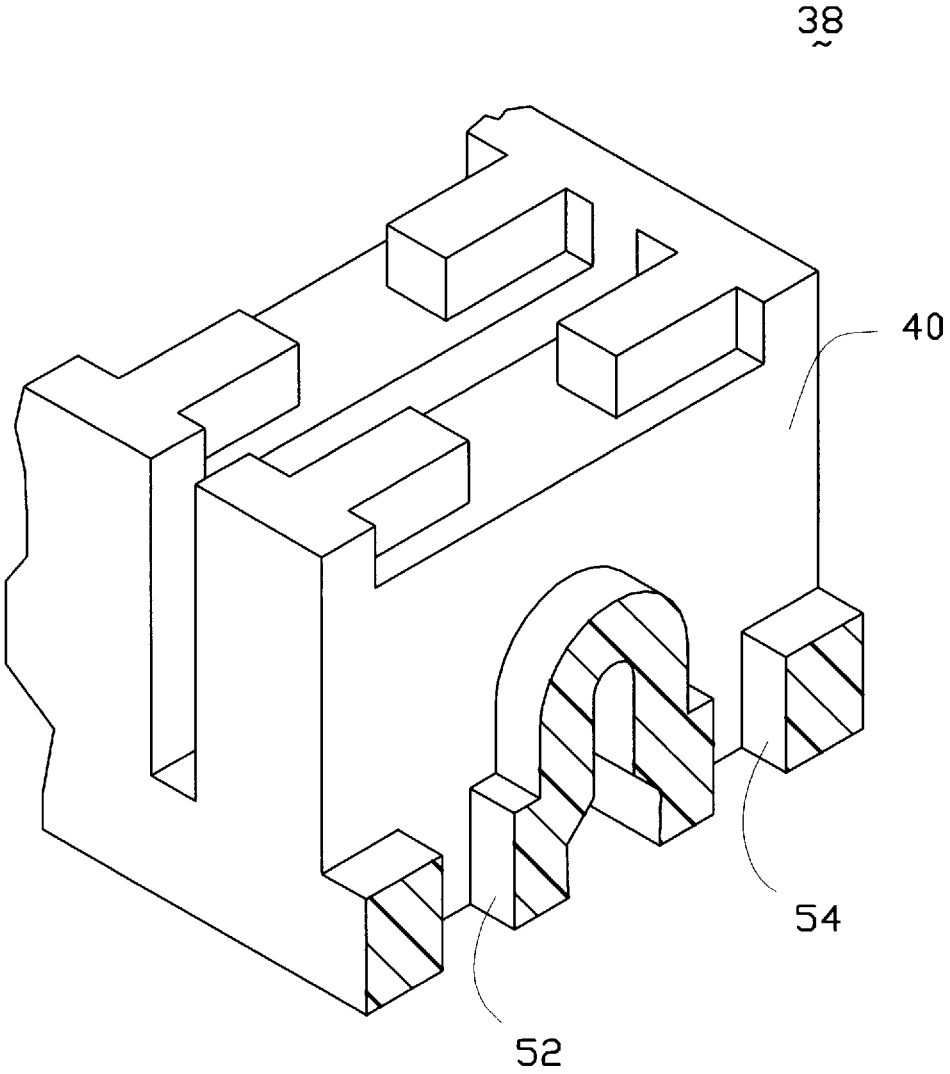
FIG. 4 is a fragmentary perspective view of the shorting bar to show the internal structures thereof.

Also referring to FIGS. 3 and 4, a grounding pin 42 is received within each of the passages 40 wherein the grounding pin 42 comprises a main body 44 with a pair of spring arms 46 upstanding at two opposite ends thereof for mechanical and electrical engagement with the corresponding pair of grounding contacts 20 positioned in the pair of passageways 16 in lateral alignment with the passage 40. A lead 48 extends downward from the main body 44 adjacent one arm 46 and through a first aperture 52 in the body 38 of the shorting bar 36, and a retention bar 50 extending downward from the main body 44 adjacent another arm 46 and in a second aperture 54 in the body 38 of the shorting bar 36. Therefore, each grounding pin 42 can be retained within the passage 40 of the shorting bar 36 and ground the corresponding pair of grounding contacts 20.

Figure 5:
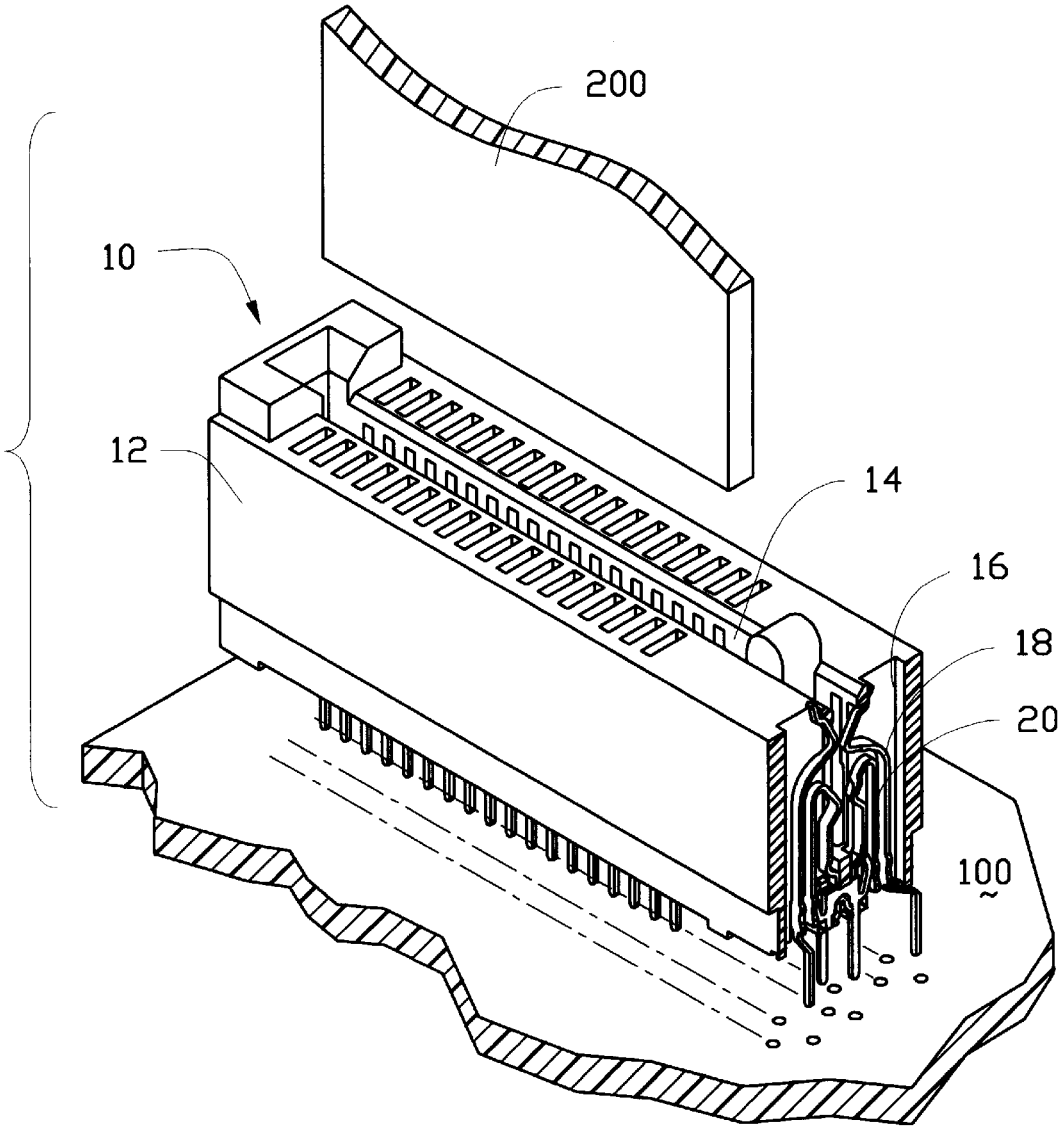
FIG. 5 is a fragmentary perspective view of the card edge connector of FIG. 1 on the board, which is cut-away along another transverse plane which show another pair of passageways and the corresponding pair of signal contacts and the corresponding grounding contacts next to the transverse plane of FIG. 2.

It can be understood that the shorting bar 36 is retained in the housing 12 by interferential engagement between the grounding contacts 20 and the arms 46 of the grounding pins 42. Additionally, also referring to FIGS. 2 and 5, because the tails of the signal contacts 18 are designedly arranged in a staggered form, the leads 48 of the grounding pins 42 are also required to be arranged in a staggered manner. Thus, the lead 48 of the grounding pins 42 is designedly arranged to extend through every two first apertures 52 or every two second apertures 54 in the shorting bar 36 along the longitudinal direction of the body 38.

It is appreciated that either the signal contacts or the grounding contacts have forming type structures with good resiliency and preloading characters, thus resulting in a desired and reliable performance in comparison with the prior arts.

It can be seen that the invention omits the tails of the grounding contacts and uses an auxiliary shorting bar for interconnecting the grounding contacts and the circuits on the PC board 100. Therefore, this provides flexibility of the whole connector assembly for compliance with variant circuits layout of the PC board by only changing the different grounding pins of the shorting bar.

Figure 6A:
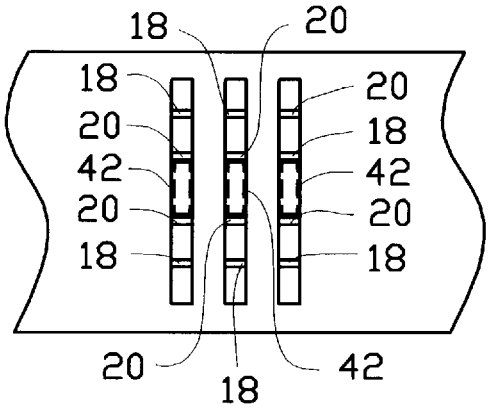
FIGS. 6A–6C show a plan view of three different groups of arrangement of the grounding pins along the shorting bar.
Figure 6B:
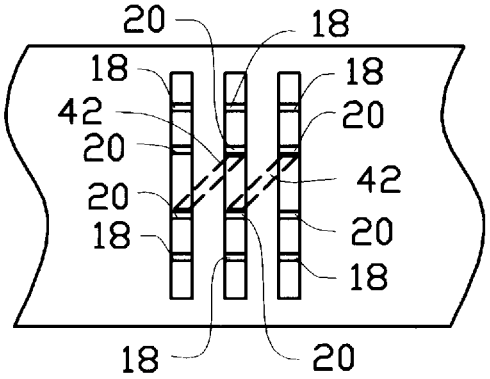
Figure 6C:
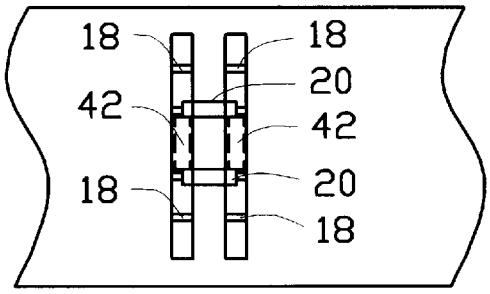

Moreover, as shown in FIG. 6, the grounding pins 42 of the shorting bar can be arranged in a diagonal manner for interconnecting diagonal grounding contacts by two sides of the central slot as shown in group B instead of group A disclosed in the first embodiment which uses the grounding pins 42 interconnecting a pair of opposite grounding contacts transversely. The variation allows the board designer to have more capability and freedom to arrange the variable PC board layout. Additionally, as shown in group C of FIG. 6, the transverse type grounding pins can be applied to the aforementioned co-pending application Ser. No. 08/585,894 which uses an integral grounding contact interconnecting a pair of adjacent circuit pads on the same sides of the inserted card. Accordingly, the grounding effect can be applied to the whole connector assembly in both longitudinal and transverse directions, forming a mesh type grounding performance instead of only the transverse type grounding or the longitudinal type grounding of the related arts.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A card edge connector comprising:

an insulative housing defining a central slot and a central cavity, said central slot receiving a card and said central cavity receiving a shorting bar therein;

two rows of passageways disposed by two sides of the central slot for respectively receiving a corresponding number of signal contacts therein;

a corresponding number of grounding contacts respectively positioned in the passageways, each of said grounding contacts sharing one same passageway with one of the corresponding signal contacts; and a series of grounding pins disposed in the shorting bar wherein each of said grounding pins includes two arms respectively engaging one pair of grounding contacts which are laterally aligned with said grounding pin.

2. The connector as defined in claim 1, wherein each pair of the signal contact and the grounding contact sharing with the same passageway are positioned at a high level and a low level, respectively.

3. The connector as defined in claim 1, wherein each pair of the signal contact and the grounding contact sharing with the same passageway are positioned on an outermost side and an innermost side, respectively.

4. The connector as defined in claim 1, wherein each pair of the signal contact and the grounding contact sharing with the same passageway have their own engagement sections at the distal ends for preloading consideration with the housing, respectively.

5. The connector as defined in claim 1, wherein grounding pins have leads extending downward out of a bottom surface of the shorting bar, and wherein said leads are arranged in a staggered manner and each of said leads is spaced, in a generally equal distance, from the corresponding pair of signal contacts which are aligned transversely with said grounding pin.

6. The connector as defined in claim 1, wherein a series of passages are disposed along a lengthwise direction of the shorting bar for receiving said grounding pins, respectively.

7. The connector as defined in claim 6, wherein corresponding to each of said passages, a first aperture and a second aperture are disposed thereabouts and communicate therewith for receiving a lead and a retention bar of the corresponding grounding pin in the passage, respectively.

8. The connector as defined in claim 7, wherein the lead is positioned adjacent one arm and the retention bar is positioned adjacent the other arm of the same grounding pin.

9. A card edge connector assembly comprising:

an insulative housing defining a central slot for receiving a card therein;

two rows of passageways disposed by two sides of the central slot for respectively receiving a corresponding number of signal contacts therein;

a corresponding number of grounding contacts respectively positioned in the passageways, each of said grounding contacts sharing one same passageway with one of the corresponding signal contacts; and a shorting bar having a series of grounding pins therein whereby each of said grounding pins is engaged with and aligned with a corresponding pair of grounding contacts.

10. The connector assembly as defined in claim 9, wherein each of the grounding pins includes a main body with two arms upstanding at two opposite ends thereof and a lead extending downward by one arm and a retention bar extending downward by the other arm.

11. The connector assembly as defined in claim 9, wherein both signal contacts and grounding contacts have preloading structures.

12. The connector assembly as defined in claim 9, the signal contacts are disposed at a high level of the housing and the grounding contacts are disposed at a low level of the housing.

13. The connector assembly as defined in claim 9, wherein the signal contacts are disposed on an outer side of the housing and the grounding contacts are disposed on an inner side of the housing.

* * * * *